US006552646B1

(12) United States Patent
Wong

(10) Patent No.: US 6,552,646 B1
(45) Date of Patent: Apr. 22, 2003

(54) CAPLESS FUSE

(75) Inventor: Chiu Kan Wong, Hong Kong (CN)

(73) Assignee: Bel-Fuse, Inc., Jersey City, NJ (US)

( * ) Notice: Subject to any disclaimer, the term of this patent is extended or adjusted under 35 U.S.C. 154(b) by 0 days.

(21) Appl. No.: 09/546,107

(22) Filed: Apr. 10, 2000

(51) Int. Cl.[7] ..... H01H 85/157; H01H 85/175

(52) U.S. Cl. ..... 337/252; 337/248; 337/231; 337/232

(58) Field of Search ..... 337/228, 232, 337/231, 248, 159, 251, 252, 290, 297; 29/623

(56) References Cited

U.S. PATENT DOCUMENTS 4,221,457 A * 9/1980 Allen et al. ..... 174/DIG. 8
4,532,489 A * 7/1985 Phillips ..... 29/623
4,540,970 A * 9/1985 Kasamatsu ..... 337/296
4,542,364 A * 9/1985 van der Scheer ..... 337/252
4,620,763 A * 11/1986 Mochida ..... 439/275
4,736,180 A * 4/1988 Oh ..... 337/163
4,972,169 A * 11/1990 Kalra ..... 337/158
4,996,509 A * 2/1991 Bernstein ..... 337/232
5,142,262 A * 8/1992 Onken ..... 29/623

FOREIGN PATENT DOCUMENTS

JP 2290007 A * 11/1990 ..... H01C/1/14
JP 2000-67735 A * 3/2000 ..... H01H/85/38

* cited by examiner

*Primary Examiner*—Anatoly Vortman
(74) *Attorney, Agent, or Firm*—Ostrolenk, Faber, Gerb & Soffen, LLP

(57) ABSTRACT

A capless fuse which includes a hollow fuse body, a fuse element within the fuse body and terminal pins having helical springs which are inserted into respective ones of the ends of the fuse body and directly connected to the ends and to the fuse element.

17 Claims, 3 Drawing Sheets

CAPLESS FUSE

BACKGROUND OF THE INVENTION

The present invention relates to tubular electrical fuses and, more particularly, to capless fuses and methods of making the same.

Conventionally, a fuse of this type includes a hollow fuse body, a fuse element extending within the body, caps for closing the ends of the body and to which the opposite ends of the fuse elements are attached, and terminal pins or leads connected to the caps.

In operation of such a conventional fuse, when excessive current flows through the fuse element, the fuse element heats, melts and then vaporizes causing a transient high pressure within the fuse body. This requires that the caps be attached to the body in such a manner that the physical integrity of the fuse is maintained during vaporization. That is, during vaporization, the caps must be able to withstand the high pressure within the fuse body without becoming detached therefrom.

The present invention is directed to a capless fuse that is able to withstand such pressure transients and maintain its physical integrity. Such capless construction enables a simpler, less expensive fuse having less exposed area that is electrically live.

Other features and advantages of the present invention will become apparent from the following description of the invention which refers to the accompanying drawings.

BRIEF DESCRIPTION OF THE DRAWING(S)

Figure 1:
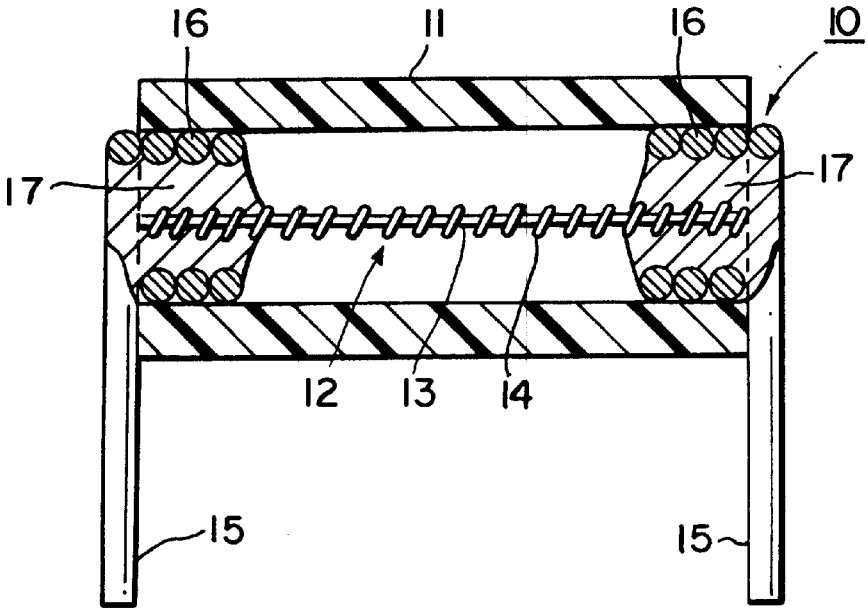
FIG. 1 is a cross sectional view of a capless fuse in accordance with a first embodiment of the invention.
Figure 3A:
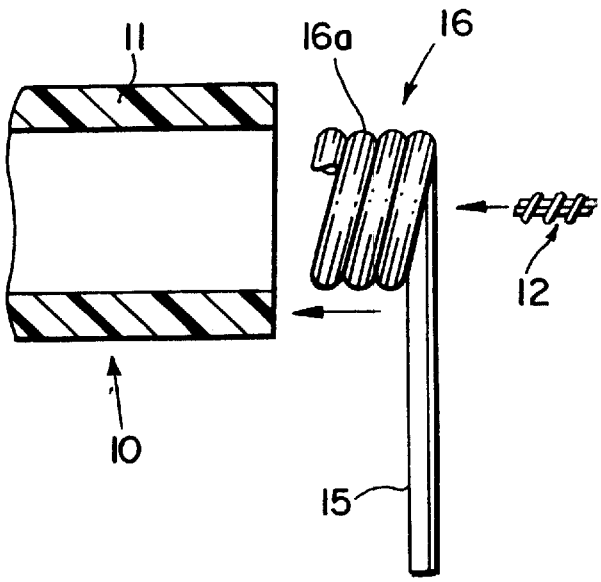

FIG. 3*a* is a fragmented, cross sectional exploded view showing steps in the assembly of the capless fuse of FIG. 1.

Figure 3B:
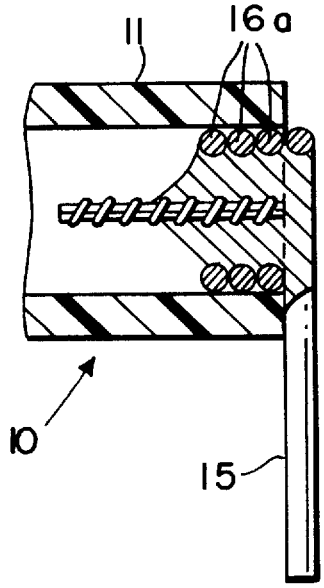

FIG. 3*b* is a fragmented, cross sectional view showing another step in the assembly of the capless fuse of FIG. 1.

Figure 4:
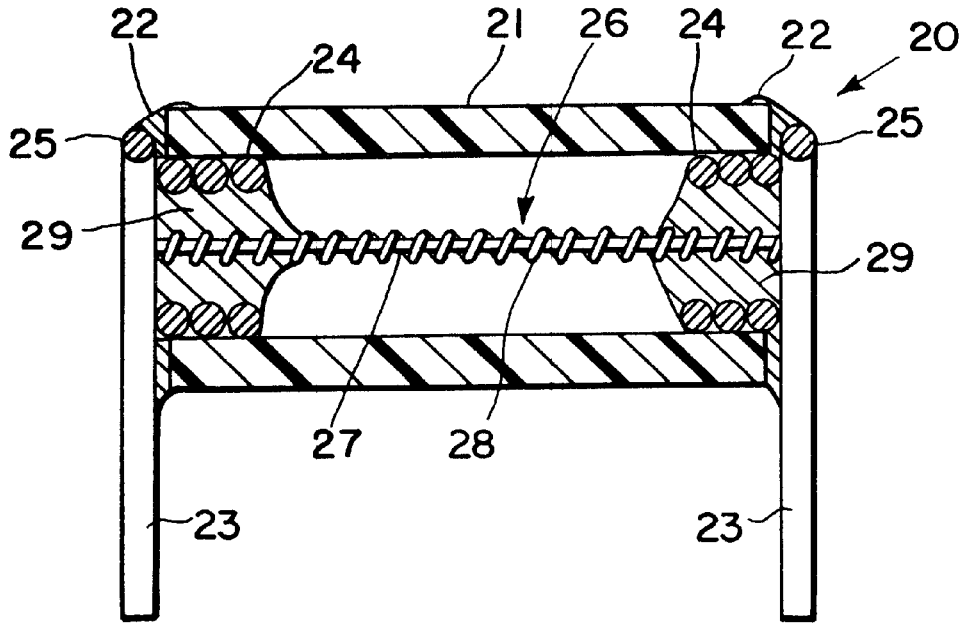

FIG. 4 is a cross sectional view of a second embodiment of the invention.

Figure 5:
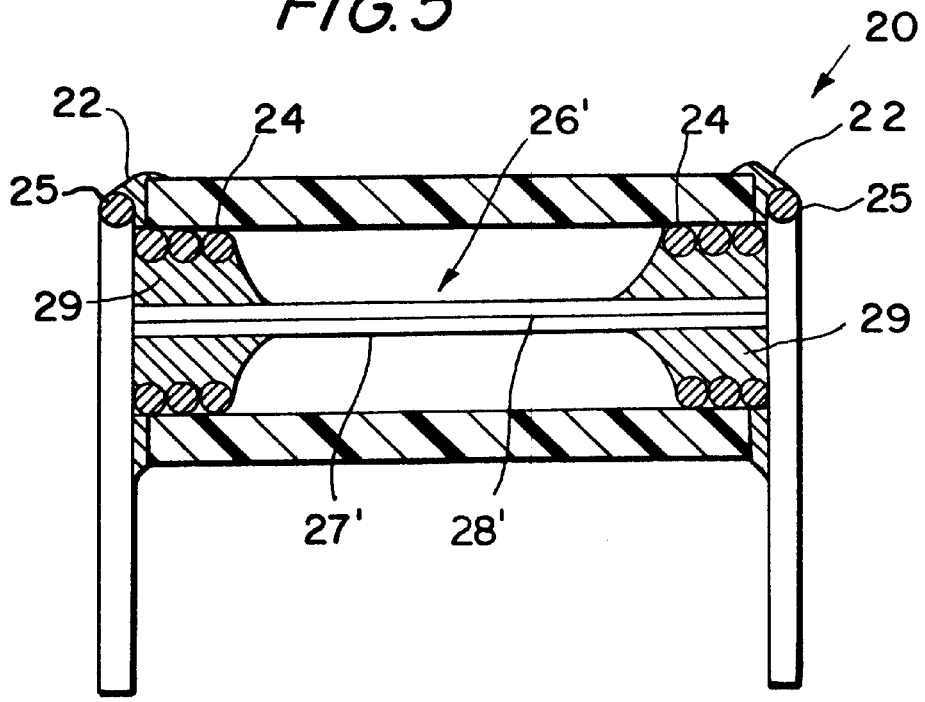

FIG. 5 shows a variation of the embodiment of the invention shown in FIG. 4.

Figure 6:
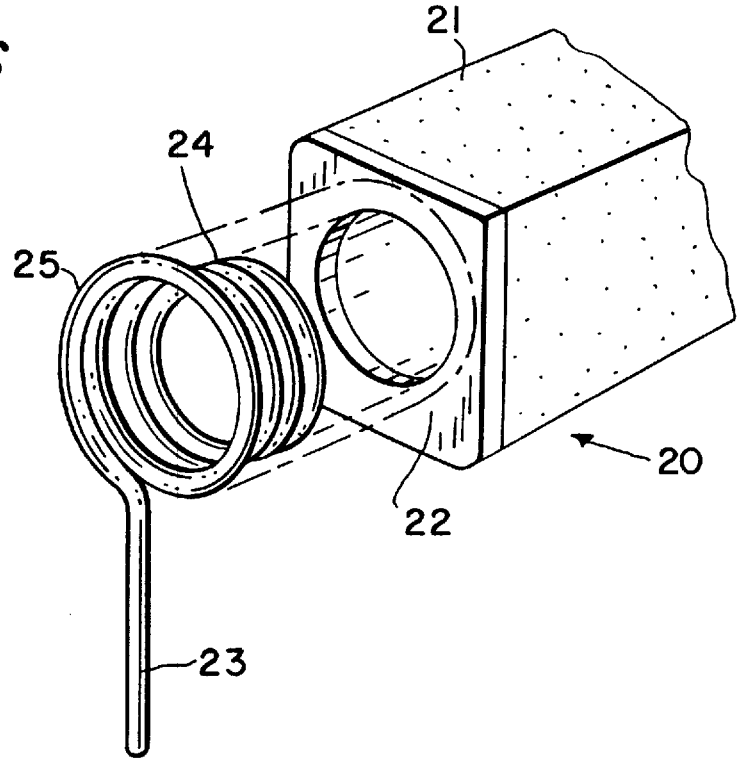

FIG. 6 is a fragmented, cross sectional exploded view showing a step in the assembly of the capless fuse of FIG. 4.

DETAILED DESCRIPTION OF EMBODIMENT (S)

Referring to FIG. 1 of the drawings, there is shown a first embodiment of a capless fuse 10 illustrating certain principles of the invention. The capless fuse 10 includes a hollow fuse body 11 which may have either a round or other cross sectional shape and which may be made of glass, ceramic, or other electrically insulating material. Disposed within the fuse body 11 is a fuse element 12 which is comprised of a substantially straight, electrically insulating core 13 of glass, ceramic or other fibers having a metallic element or elements 14 wound helically thereabout or coated thereon. The fuse 10 also includes a pair of terminals 15, 15, each of which has one end formed into a multi-turn helical spring 16 having a pitch slightly greater than the diameter of the wire from which the terminal is made. Each of the springs 16, 16 is sized to be press fit into a respective end of the hollow body 11 and is retained therein by spring pressure. Advantageously, the ends of the body 11 may be fire polished or may have the end regions of its interior wall scuffed to enhance locking of the springs 16, 16 within the body 11.

The respective ends of fuse element 12 are received within respective openings defined by the helical springs 16, 16. Preferably, the ends of the fuse element 12 are attached by solder 17 to respective springs 16, 16 in such a way as to flood the helical springs 16, 16 with enough molten solder to affect blockage of the ends of hollow body 11. The solder 17 wets and engulfs the multiple turns 16*a* of helical springs 16, 16 to produce a plug of substantial depth and thermal mass so as to resist perforation by electrical arcing associated with vaporization of the metal element 14 of the fuse element 12.

Figure 2:
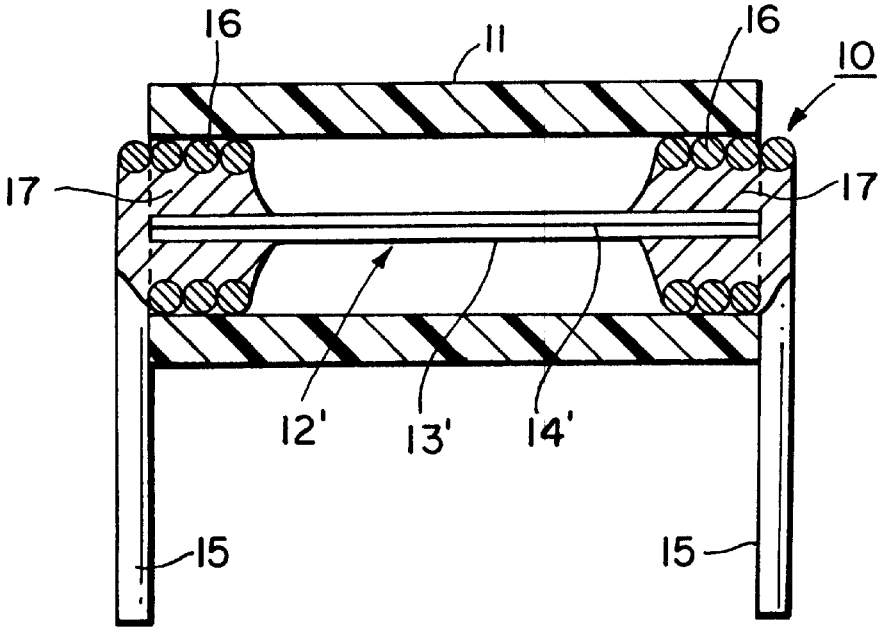
FIG. 2 is a cross sectional view of a variation of the embodiment of the invention shown in FIG. 1.

Referring to FIG. 2, there is shown a variation of the capless fuse 10 which employs a fuse element 12' composed of one or more substantially straight, wavy or intertwined metallic elements 14'.

Referring now to FIG. 3*a*, in assembly of the capless fuse 10, the helical springs 16, 16 (only one of which is shown) of the terminal pins 15, 15 are press fit into respective ends of the hollow body 11. Then, the fuse element 12 (or 12') is inserted into the interior of the hollow body 11 through the openings defined in the helical springs 16, 16.

Thereafter, as shown in FIG. 3*b*, the ends of the fuse element 12 (or 12') are attached by solder 17 to the helical springs 16, 16 (only one of which is shown). As molten solder floods the portions of the hollow fuse body 11 containing the helical springs 14, 14, it solidifies from the outside in, reducing its volume by 4%, as it changes from liquid to solid. This, in turn, causes the turns 16*a* of each helical spring 16 to be drawn together, (i.e., causes the pitch to be reduced) causing the diameter of the helical springs 16, 16 to attempt to increase slightly and, thereby, to bear more heavily on the inner end wall of the body 11, positively securing the helical springs 16, 16. Further, the solder 17 also serves as a filler, causing the outer surfaces of the helical springs 16, 16 to gain additional purchase by conforming advantageously to the shape, irregularities, fire polishing and scuffing of the inside ends of the body 11.

In operation, it has been found that even though the fuse 10 does not have a cap, the fuse 10 is able to maintain its physical integrity as the metal component 14 (or 14') of the fuse element 12 (or 12') vaporizes.

Referring now to FIG. 4, there is shown an alternative embodiment of the invention. This embodiment is directed to a capless fuse 20, which includes a hollow body 21 having a square or other cross sectional shape and which is preferably made of ceramic. The ends 22 of the body 21 are metallized. A pair of terminal pins 23, 23 are attached to respective ends of the body 11. Each terminal pin 23 has one end formed into a multi turn, open helical spring 24 as shown in the embodiment of FIG. 1. However, the outermost turn 25 of each spring 24 is of an expanded diameter (see FIG. 6) and is formed such that it will lie against the metallized end face of the body 21 when springs 24, 24 are inserted into respective ends of the fuse body 21. A fuse element 26 is disposed within the fuse body 21 and has opposite ends that extend through the openings defined by the helical springs 24, 24.

Like the embodiment of the invention shown in FIG. 1, the fuse element 26 in this embodiment comprises an electrically insulating, substantially straight, core 27 of glass, ceramic or other fibers having a metallic element or elements 28 wound helically thereabouts or coated thereupon and, like the variation of the first embodiment shown in FIG. 2, a variation of this embodiment shown in FIG. 5 includes a fuse element 26' having a substantially straight or wavy metallic element or elements 28'.

In the assembly of the capless fuse 20, the ends 22 of the fuse body 21 are first metallized with a solderable metal or alloy in a conventional fashion. Then, as shown in FIG. 6, the helical springs 24, 24 (only one of which is shown) are inserted into the respective ends of the hollow body 21 such that the larger diameter turns 25, 25 of springs 24, 24 lay on, or in close proximity to, the metallized end faces 22 of the body 21. Solder or other bonding means, such as welding, may then be used to affix the outer turns 25, 25 of springs 24, 24 to the metallized end faces of the hollow body 21, respectively. Thereafter, the fuse element 26 (or 26') is inserted into the body 21 through the openings defined by the helical springs 24, 24. Then, the ends of the fuse element 26 (or 26') are attached with solder 29 in such a way as to flood the helical springs 24, 24 with enough molten solder to affect blockage of the ends of the hollow fuse body 21. The solder 29 wets and engulfs the multiple turns of helical springs 24, 24 and the outermost turns 25, 25 to produce a plug of substantial depth and thermal mass so as to resist perforation by electrical arcing associated with vaporization of element 28 (or 28'). As was the case with the first embodiment, solidification of the solder causes a reduction in the pitch of each helical spring 24, thereby causing the helical springs to attempt to increase their diameters to more positively secure the helical springs.

In operation, the capless fuse 20, like the capless fuse 10, is able to maintain its physical integrity when subjected to high transient internal pressures produced by the vaporization of element 28 (or 28'). The purpose of the embodiment shown in FIGS. 4–6 is to provide enhanced bonding between hollow body 21 and terminal pins 23, 23 in situations where high peak pressures exceeding the capabilities of the embodiment shown in FIGS. 1–3 may be encountered.

Although the present invention has been described in relation to particular embodiments thereof, many other variations, modification and other uses will become apparent to those skilled in the art. It is preferred, therefore, that the present invention be limited not by the specific disclosure herein, but only by the appended claims.

What is claimed is:

1. A capless fuse, comprising:

a hollow fuse body having opposed ends;

a fuse element having opposed ends disposed within the fuse body; and a pair of terminal pins having first and second ends, the respective first ends of the terminal pins being connected directly to respective ones of the opposed ends of the fuse body and to the opposed ends of the fuse element, wherein each of the first ends of the terminal pins comprises a helical spring which is connected directly to the fuse body by spring pressure.

2. A capless fuse according to claim 1, wherein the helical springs define respective openings for receiving respective opposed ends of the fuse element.

3. A capless fuse according to claim 2, wherein the helical springs are open wound helical springs.

4. A capless fuse according to claim 3, wherein the helical springs are soldered, the solder causing an increase in the diameters of the helical springs to cause the helical springs to bear more heavily on the inside wall of the fuse body to thereby more securely retain the helical springs within the fuse body.

5. A capless fuse according to claim 2, wherein the helical springs maintain the fuse element in a substantially centered position in the fuse body.

6. A capless fuse according to claim 2, wherein the helical springs maintain the fuse element in a position spaced from any contact with the fuse body.

7. A capless fuse according to claim 2, wherein the opposed ends of the fuse element are soldered to the helical springs of the first ends of the terminal pins, respectively.

8. A capless fuse according to claim 1, wherein the helical spring has a pitch slightly greater than a diameter of the terminal.

9. A capless fuse according to claim 2, wherein the fuse element comprises a core of an electrically insulating material having a metallic element wound thereon.

10. A capless fuse according to claim 2, wherein the fuse element comprises a core of glass fibers having a metallic element wound thereabout.

11. A capless fuse according to claim 2, wherein the fuse element comprises a core of an electrically insulating material having a metallic coating thereon.

12. A capless fuse according to claim 11, wherein the core comprises a plurality of glass fibers.

13. A capless fuse according to claim 1, wherein the opposed ends of the fuse body are metallized and each helical spring has an outer turn which is bonded to a respective one of the opposed ends of the fuse body.

14. A capless fuse according to claim 13, wherein the outer turn of each helical spring has a larger diameter than other turns of the helical spring.

15. A capless fuse according to claim 14, wherein the outer turn is disposed outside of the fuse body and proximate to a metallized end face of the fuse body.

16. A capless fuse according to claim 13, wherein the fuse element comprises a core of glass fibers having a metallic element wound thereabout.

17. A capless fuse according to claim 13, wherein the fuse element comprises a core of glass fibers having a metallic coating thereon.

* * * * *